United States Patent [19]

Tienari

[11] 4,399,876

[45] Aug. 23, 1983

[54] REVERSING MECHANISM FOR THE DIRECTION OF ROTATION IN A DRILLING APPARATUS

[75] Inventor: Ossi Tienari, Kilvakkala, Finland

[73] Assignee: OY Tampella AB, Tampere, Finland

[21] Appl. No.: 293,422

[22] Filed: Aug. 17, 1981

[30] Foreign Application Priority Data

Sep. 10, 1980 [FI] Finland ..... 802838

[51] Int. Cl.[3] ..... B23Q 5/033

[52] U.S. Cl. ..... 173/147; 173/105; 175/57; 408/9; 408/17

[58] Field of Search ..... 173/15, 16, 18, 19, 173/45, 104, 108, 145, 147, 157, 159, 105; 408/9, 17; 175/57

[56] References Cited

U.S. PATENT DOCUMENTS

| | | | |
|---|---|---|---|
| 3,012,619 | 12/1961 | Farque | 173/145 X |
| 3,183,668 | 5/1965 | Johnson et al. | 173/104 X |
| 3,307,638 | 3/1967 | Kurt | 173/105 |
| 3,319,725 | 5/1967 | Edwards | 173/159 X |
| 4,341,271 | 7/1982 | Anttila | 173/105 X |

*Primary Examiner*—Harold D. Whitehead
*Assistant Examiner*—Robert P. Olszewski
*Attorney, Agent, or Firm*—Ladas & Parry

[57] ABSTRACT

A mechanism for reversing the direction of rotation in a drilling apparatus comprising a feeding beam (1) and a drilling machine (3) supported by the beam for longitudinal movement back and forth along the beam in a drilling direction (A) and an opposite return direction (B) by a feeding mechanism (4). The drilling machine is provided with a pressure medium driven rotating device (9) for rotating a drilling rod and with a reversing valve (13) connected to the pressure medium system of the rotating device. The reversing valve is provided with a spindle rotatable between two positions in which the rotating device rotates the drilling rod in opposite directions. The reversing mechanism comprises two actuating elements (24,27) rotatable with respect to each other. One element (24) is in rotational engagement with the spindle and is moved axially together with the spindle at least at the end of the return direction of the drilling machine. The other element (27) is arranged to maintain non-rotating and stationary by a fixed stop (31) in the feeding beam at the end of the return direction but to rotate and move axially with respect to the one element at the beginning of the drilling direction. The actuating elements are coupled to each other by members (28,29) which force said one element to rotate with respect to the other element when the elements move axially with respect to each other and thereby to rotate also the spindle to a position causing a reversal of the direction of rotation of the rotating device.

8 Claims, 5 Drawing Figures

REVERSING MECHANISM FOR THE DIRECTION OF ROTATION IN A DRILLING APPARATUS

Figure 1:
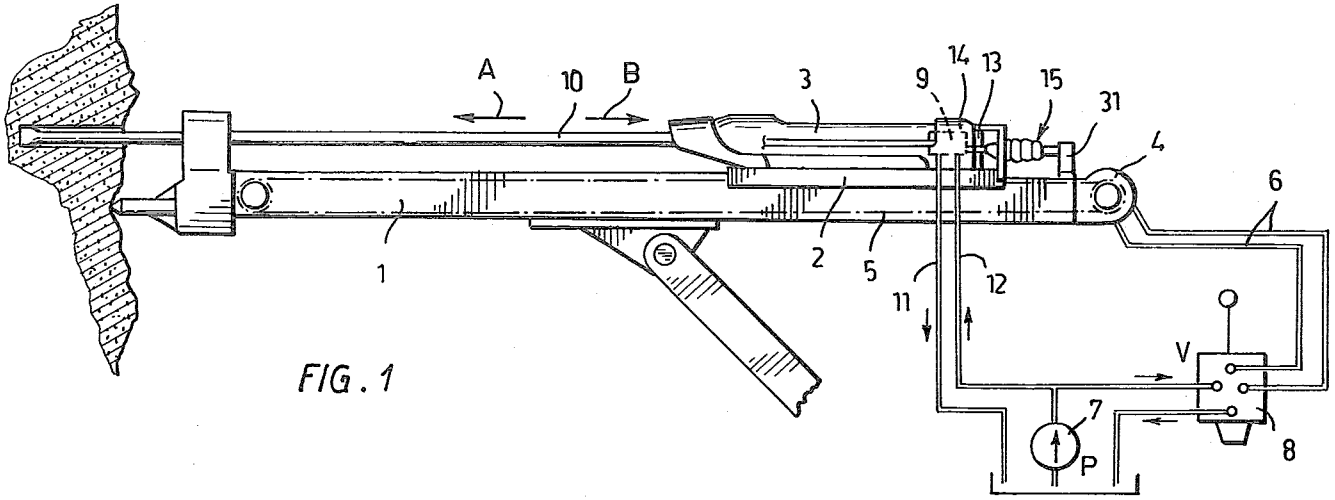

The present invention relates to a reversing mechanism for the direction of rotation in a drilling apparatus comprising a feeding beam, a drilling machine displaceably mounted on said feeding beam, and a feeding mechanism for displacing said drilling machine along said feeding beam in the direction of drilling and in an opposite return direction, said drilling machine being provided with a pressure medium driven rotating device for rotating a drilling rod to be fastened to the drilling machine and with a reversing valve connected to the pressure medium system of the rotating device and having a spindle pivotable between two positions in which the rotating device rotates said drilling rod in opposite directions, and means for pivoting said spindle into said positions.

When carrying out drilling by means of a percussion drilling rod which rotates around its longitudinal axis and is connected to a drilling machine provided with a pressure medium driven rotating motor, it is known that certain advantages can be achieved by reversing the direction of rotation of the drilling rod always when starting drilling of a new hole. For this purpose, the drilling machine is provided with a reversing valve provided with a spindle which is pivoted by means of a manual lever to an alternate operational position in which the valve connects the pressure medium channels of the rotating motor in such a way that the direction of rotation of the motor is reversed.

When drilling apparatuses are concerned in which a hand drilling machine is mounted on a special feeding beam and the drilling machine is fed in the direction of drilling and returned to its initial position along the beam by means of a pressure medium driven feed motor, it is known to arrange the reversal of the rotation of the drilling rod to take place automatically. For this purpose, a hydraulic reversing mechanism has been developed in which an impulse valve pressurizes the end of a spindle provided in a reversing valve mounted in the rotating motor rotating the drilling rod when it is desired to reverse the direction of rotation so that the spindle is displaced and opens pressure medium channels for rotation in the opposite direction. Alternatively, pressure-air impulses and electro-magnetic coils can be utilized for displacing the spindle.

The reversing mechanisms known hitherto require special impulses and precontrolled valves. Because the drilling machine is a pressure medium driven hand machine, in which the reversal of the direction of rotation must be carried out from a manual drilling situation, the known reversing mechanism constructions, by means of which the reversal of the direction of rotation is automatically accomplished while the hand machine is mounted on the feeding beam of the drilling apparatus, are relatively complicated and expensive.

It is the object of the present invention to provide a reversing mechanism which eliminates the above-mentioned disadvantages, and this object is achieved by means of a reversing mechanism according to the invention which is characterized in that said reversing mechanism comprises two actuating elements rotationally mounted in relation to each other, one of said elements being in rotational engagement with the spindle of said reversing valve at least at the end of said return direction of the drilling machine and moving axially together with said spindle and the other of said elements being arranged to maintain non-rotating and stationary at the end of said return direction but to rotate and move axially in relation to said one element at the beginning of said drilling direction of said drilling machine, and in that said actuating elements are provided with means for forcing said actuating elements to rotate in relation to each other as they move in the axial direction of said spindle relative to each other.

According to the invention there is provided a reversing mechanism which is simple in construction and utilizes the movement of the drilling machine at the end of the return direction for producing the rotary movement of the spindle of the reversing valve. The movement of the drilling machine, when pulled by the feed motor, against a fixed stop in the feeding beam produces an axial force which the reversing mechanism converts into a rotary movement by means of which the rotation of the spindle of the reversing valve is achieved. In this way, the direction of rotation is automatically reversed always when the drilling machine has been returned to the initial position upon completion of the drilling. In its simplest form, the reversing mechanism can comprise a pin, a bushing, a spring and a ball-groove guide which converts the axial movement into a rotary movement with an angle of rotation which can be selected to the desired magnitude, for example, 180°. The reversing mechanism according to the invention does not prevent the reversing valve to be provided in a conventional manner with an actuating lever for manual reversal when the drilling machine is used for manual drilling taking place separately from the drilling apparatus or at any stage of the drilling when the drilling machine is mounted in the drilling apparatus.

Figure 5:
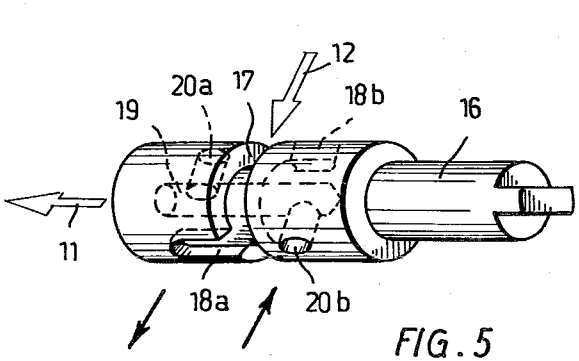
Figure 4:
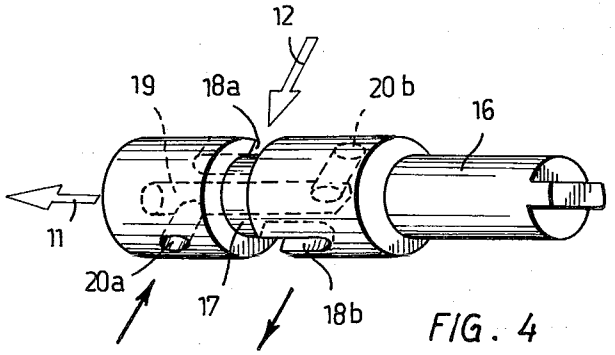
Figure 2:
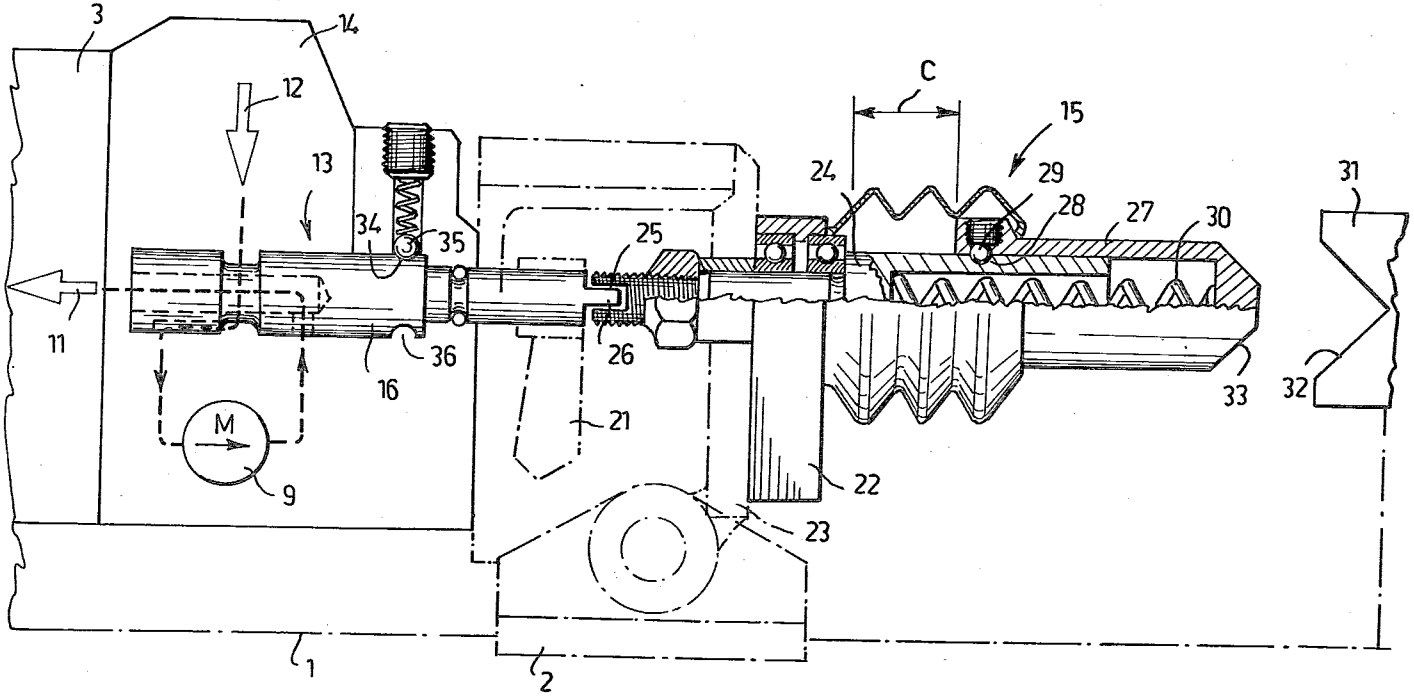
Figure 3:
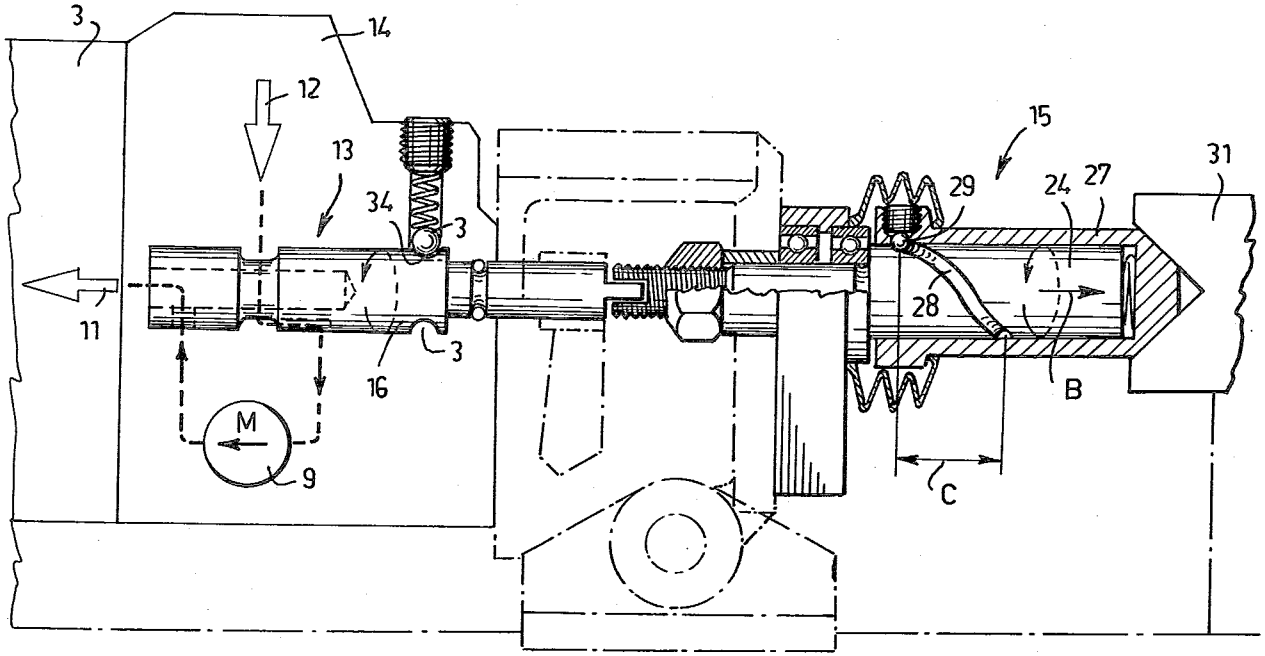

In the following the invention will be described closer with reference to the accompanying drawings in which FIG. 1 is a side view of a drilling apparatus which is provided with a reversing mechanism according to the invention, FIGS. 2 and 3 illustrate on an enlarged scale a preferred embodiment of the reversing mechanism according to the invention as side views at the beginning of the reversing movement and at the end of the reversing movement, respectively, and FIGS. 4 and 5 illustrate the spindle of the reversing valve of a drilling machine as side views in two different positions which correspond to rotation of the rotating motor in opposite directions.

The drilling apparatus shown in FIG. 1 of the drawings mainly comprises a feeding beam 1 parallel with the desired direction of drilling, a sleigh 2 sliding along the feeding beam, and a hand drilling machine 3 removably fastened on the sleigh. The feeding beam is provided with a hydraulic feed motor 4 which by means of a chain 5 displaces the sleigh 2. The feed motor is by means of conduits 6 connected to a hydraulic pump 7, and the motor is controlled by means of a separate manually operated valve 8. The drilling machine is provided with a hydraulic rotating motor 9 of its own which rotates a drilling rod 10 connected to the machine around its axis. The rotating motor is by means of conduits 11,12 connected either to a hydraulic pump of its own or to the hydraulic pump of the feed motor through a reversing valve 13 which is mounted in the body 14 of the drilling machine. In addition, the drilling apparatus is provided with a reversing mechanism 15 by means of which the direction of the rotating motor is automatically reversible, as will be described hereinafter.

From FIGS. 2 and 3 appears that the reversing valve 13 of the drilling machine is of a spindle type known per se provided with a spindle 16 which rotates around its axis and has a central annular inlet channel 17 from which two connecting grooves 18*a*,18*b* extend in opposite direction, said grooves being located on the mantle surface of the spindle at a distance of 180° from each other. The spindle has an axial outlet channel 19 from which two connecting bores 20*a*,20*b* extend in opposite directions, said bores terminating on the mantle surface of the spindle at a distance of 180° from each other.

The pressure medium conduits of the rotating motor of the drilling machine are connected with the reversing valve so that, as one of the conduits is communicating with one of connecting grooves, the other conduit is communicating with the other connecting groove. Thus, depending on the rotary position of the spindle, one of the conduits of the rotating motor will always be pressurized and the other conduit will communicate with a tank so that the direction of rotation is reversed when the spindle is rotated over 180°. For manual rotation, a hand lever 21 is fastened to the spindle.

The reversing mechanism 15 comprises a frame plate 22 which is secured to a support 23 in the rear end of the drilling machine. To the frame plate is pivotally journalled a pivot shaft 24 positioned on the axial extension of the spindle 16. The projecting end of the pivot shaft is provided with a slot 25 which is in rotational engagement with an ear 26 provided in the end of the spindle. A bushing 27 is rotationally journalled around the opposite cylindrical end portion of the pivot shaft. A helical guide groove 28 extending along an arc of 180° is formed on the mantle surface of the pivot shaft. In the inner mantle surface of the bushing is arranged a guide ball 29 extending into said guide groove. A compression spring 30 mounted within the bushing tends to push the bushing away from the pivot shaft so that the ball is located at one end of the groove, as shown in FIG. 2.

A stop 31 is fastened at the rear end of the feeding beam 1. Said stop is positioned at the path of movement of the reversing mechanism and has a V-shaped notch 32 directed towards the reversing mechanism. A corresponding V-shaped projection 33 is formed at the end of the bushing 27.

The reversing mechanism operates in the following manner:

When drilling a hole, the feed motor 4 displaces the drilling machine in the drilling direction A, FIG. 1. When the hole has been drilled and the direction of movement of the feed motor has been reversed by means of the valve 8, the feed motor moves the drilling machine in the return direction B. At the end of the return movement, the V-shaped end 33 of the bushing of the reversing mechanism extends into the V-shaped notch 32 of the stop of the feeding beam so that the movement of the bushing is stopped. As the drilling machine further continues its return movement, the pivot shaft 24 is displaced into the bushing so that the spring is compressed. Because the V-shaped notch 32 prevents the bushing from rotating, the movement of the guide ball 29 in the guide groove 27 forces the pivot shaft to rotate over 180° as the pivot shaft continues its axial movement over a distance C corresponding to the pitch of the helical guide groove 27. Thereby a locking ball 35 protruding into a seat 34 on the surface of the spindle of the reversing valve rolls up on the surface of the spindle and permits the rotation of the spindle together with the pivot shaft over 180° in which position the locking ball snaps into another seat 36 on the surface of the spindle. The rotation of the spindle produces a reversal of the direction of rotation of the rotating motor of the drilling machine in the opposite direction, as described above.

When the drilling machine has reached the extreme position of its return movement (FIG. 3), the feed motor 4 is coupled to again move the drilling machine in the drilling direction for drilling a new hole. At this moment, the pivot shaft 24 of the reversing mechanism starts to move out from the bushing 27 as the spring 30 forces the parts away from each other. Thereby, the ball-groove guiding 28, 29 between the pivot shaft and the bushing forces the bushing to rotate over 180° on the pivot shaft back to the initial position shown in FIG. 2. The force of the locking ball 35 must be sufficiently great to overcome the friction between the bushing and the pivot shaft so that the spindle is unable to rotate back after the drilling movement of the drilling machine has started. When the drilling machine the next time approaches the stop 31 at the end of the return movement, the reversing mechanism is again compressed so that the spindle of the reversing valve again rotates over 180° and the direction of the rotating motor is reversed.

The drawings and the description related thereto are only intended to illustrate the idea of the invention. In its details, the reversing mechanism may vary considerably within the scope of the claims. Instead of having the reversing mechanism fastened to the sleigh for movement along with the drilling machine, the reversing mechanism can be fastened to the stop in the feeding beam so that the pivot shaft of the reversing mechanism is rotationally engaged with the spindle of the reversing valve only at the end of the return movement for producing the rotary movement of the spindle. Instead of rotating the spindle over 180°, any other angle of rotation evenly included in a full rotation, for example 120° or 90°, can be selected. In this case, the spindle must be provided with a corresponding number of additional connecting grooves and connecting bores on the periphery with a corresponding distribution.

What I claim is:

1. A reversing mechanism for the direction of rotation in a drilling apparatus comprising a feeding beam (1), a drilling machine (3) displaceably mounted on said feeding beam, and a feeding mechanism (4) for displacing said drilling machine along said feeding beams in a drilling direction (A) and in an opposite return direction (B), said drilling machine being provided with a pressure medium driven rotating device (9) for rotating a drilling rod (10) to be fastened to said drilling machine and with a reversing valve (13) connected to the pressure medium system of said rotating device and having a spindle (16) rotatable between two positions in which said rotating device rotates said drilling rod in opposite directions, and means for rotating said spindle into said positions, characterized in that said reversing mechanism (15) comprises two actuating elements (24,27) rotationally mounted with respect to each other, one (24) of said elements being in rotational engagement with the spindle (16) of said reversing valve (13) and moving axially with said spindle at least at the end of said return direction (B) of the drilling machine and the other (27) of said elements being arranged to maintain non-rotating and stationary at the end of said return direction (B) but to rotate and move axially with respect to said one actuating element (24) at the beginning of said drilling direction (A) of said drilling machine, and in that said actuating elements are provided with means (28,29) for forcing said actuating elements to rotate with respect to each other as they move in the axial direction of said spindle (16) with respect to each other.

2. A reversing mechanism as claimed in claim 1, characterized in that one (24) of said actuating elements is rod-shaped and the other element (27) is bushing-shaped, that said bushing-shaped actuating element is arranged axially slideably around said rod-shaped actuating element, and that guide means (28,29) are provided between said actuating elements, said guide means forcing said one element (24) to rotate with respect to said other element (27) as said elements move axially with respect to each other.

3. A reversing mechanism as claimed in claim 2, characterized in that said reversing mechanism (15) is arranged to move along with said drilling machine (3), and that said feeding beam (1) is provided with a stop (31), against which one (27) of said actuating elements hits and which prevents rotation of said element at the end of the return direction (B) of said drilling machine.

4. A reversing mechanism as claimed in claim 3, characterized in that said reversing mechanism (15) is provided with means (22) for fastening it to the body (14) of said drilling machine (3).

5. A reversing mechanism as claimed in claim 3 or 4, characterized in that one (24) of said actuating elements (24) is provided with a coupling (25) for connecting said element into rotational engagement with said spindle (16) of said reversing valve (13).

6. A reversing mechanism as claimed in claim 2, characterized in that said reversing mechanism (15) is arranged to be fastened on said feeding beam (1), and that said drilling machine (3) is provided with a stop, against which one (24) of said actuating elements hits and which causes an axial movement and rotation of said element with respect to the other fixed actuating element (27) at the end of the return direction of said drilling machine.

7. A reversing mechanism as claimed in claim 3 or 6, characterized in that between said rod-shaped actuating elements (24) and said bushing-shaped actuating element (2) is provided a spring (30) which pushes said elements axially away from each other.

8. A reversing mechanism as claimed in claim 2, characterized in that a helical groove (28) is formed in the mantle surface of one (24) of said actuating elements and a guide member (29) extending into said groove is provided in the mantle surface of the other actuating element (27), said guide member causing a rotation of one actuating element around its axis with respect to the other actuating element when said actuating elements are axially displaced with respect to each other.

* * * * *